US005677056A

United States Patent [19]

Golz

[11] Patent Number: 5,677,056

[45] Date of Patent: Oct. 14, 1997

[54] WEBBING HAVING A CATCH CORD FABRICATED FROM BIOCOMPONENT YARN

[75] Inventor: Robert E. Golz, Swansea, Mass.

[73] Assignee: Murdock Webbing Company, Inc., Central Falls, R.I.

[21] Appl. No.: 743,758

[22] Filed: Nov. 7, 1996

[51] Int. Cl.[6] ..... D02G 3/00; D03D 3/00; D03D 47/42; D03D 15/00

[52] U.S. Cl. ..... 428/373; 428/192; 428/193; 139/385; 139/431; 139/420 A; 139/387 R

[58] Field of Search ..... 139/387 R, 431, 139/420 A, 385; 428/373, 192, 193

[56] References Cited

U.S. PATENT DOCUMENTS

| | | | |
|---|---|---|---|
| 3,550,642 | 12/1970 | DesRosiers | 139/385 |
| 5,219,636 | 6/1993 | Golz | 428/193 |
| 5,419,951 | 5/1995 | Golz | 428/373 |
| 5,467,802 | 11/1995 | Lusen et al. | 139/385 |

*Primary Examiner*—Newton Edwards
*Attorney, Agent, or Firm*—Salter & Michaelson

[57] ABSTRACT

An elongate webbing has opposed longitudinal edges formed from warp and fill yarns interwoven together, and a catch cord for interconnecting the fill yarns adjacent one of the longitudinal edges. The catch cord is fabricated from a yarn having a component with a melting point lower than the warp and fill yarns for bonding of the catch cord with the warp and fill yarns when being subjected to a melting temperature sufficient to melt the catch cord but not the warp and fill yarns. More specifically, the catch cord is fabricated from a bicomponent yarn having a plurality of individual filaments, each filament having a core and an outer sheath. The melting point of the sheath of each filament is lower than that of its core. The core of each filament is preferably fabricated from polyester having a melting point at about 489° F., and the sheath of each filament is fabricated from a group consisting of nylon-6, polypropylene, or polyethylene, or any other material having a lower melting point than the melting point of the core.

4 Claims, 2 Drawing Sheets

WEBBING HAVING A CATCH CORD FABRICATED FROM BIOCOMPONENT YARN

BACKGROUND AND SUMMARY OF THE INVENTION

This invention relates generally to cords and ropes, and more particularly to a webbing having a catch cord fabricated from bicomponent yarn for use in commercial settings, such as for strapping, safety ropes, and the like.

Webbing having interwoven warp and weft or fill yarns is well-known in the art of textile manufacturing. U.S. Pat. Nos. 5,219,636 and 5,419,951, both to Robert E. Golz, disclose webbing having abrasion resistant yarns interwoven therein. More particularly, each patent discloses a bicomponent yarn that is used for increasing the strength and abrasion resistance of the article, for example, a sling, made from the webbing. This bicomponent yarn has a plurality of filaments, each filament having an inner core fabricated from polyester, and an outer sheath fabricated from a material having a lower melting point than the polyester core. By subjecting the sling to a temperature sufficient to melt the sheaths of the filaments, but not the cores, the strength and abrasion resistance of the webbing is increased.

One drawback associated with webbing fabricated in the manner described above is that the weft or fill yarns, when produced on certain weaving machines, remain loose on one of the two long edges of the webbing. This can result in the unravelling of the webbing should stress be exerted on any of the fill yarns. One solution to this problem has been to interlace a catch cord with the fill yarns which "ties" the open loops created by the fill yarns on the long side of the webbing. However, should the catch cord break, and a pulling force be exerted on the catch cord, it too can unravel. It has been discovered that by using a bicomponent yarn as described above as the catch cord, and by heating the catch cord to a temperature sufficient to melt the outer sheaths of the bicomponent yarn, the bicomponent yarn melts and adheres to the warp and weft yarns for securing the loops of the fill yarns and preventing the webbing from unravelling.

The present invention is directed to an elongate webbing having opposed longitudinal edges formed from warp and fill yarns interwoven together, and a catch cord for interconnecting the fill yarns adjacent one of the longitudinal edges. The catch cord is fabricated from a yarn having a component with a melting point lower than the warp and fill yarns for bonding of the catch cord with the warp and fill yarns when being subjected to a melting temperature sufficient to melt the catch cord but not the warp and fill yarns. More specifically, the catch cord is fabricated from a bicomponent yarn having a plurality of individual filaments, each filament having a core and an outer sheath. The melting point of the sheath of each filament is lower than that of its core. The core of each filament is preferably fabricated from polyester having a melting point at about 489° F., and the sheath of each filament is fabricated from a group consisting of nylon-6, polypropylene, or polyethylene, or any other material having a lower melting point than the melting point of the core.

Accordingly, among the several objects of the present invention are the provision of an improved webbing having a catch cord fabricated from bicomponent yarn which, when heat treated, prevents the unravelling of the webbing during stressful use thereof; the provision of such an improved webbing which is sturdy in construction and useful for commercial purposes, such as for strapping items in place, safety ropes and the like; the provision of such an improved webbing which is economical to manufacture; and the provision of such an improved webbing which can be manufactured from existing weaving equipment.

Other objects, features and advantages of the invention shall become apparent as the description thereof proceeds when considered in connection with the accompanying illustrative drawings.

BRIEF DESCRIPTION OF THE DRAWINGS

In the drawings which illustrate the best mode presently contemplated for carrying out the present invention.

Corresponding reference numerals designate corresponding parts throughout the several views of the drawings.

DETAILED DESCRIPTION OF THE PREFERRED EMBODIMENT

Figure 1:
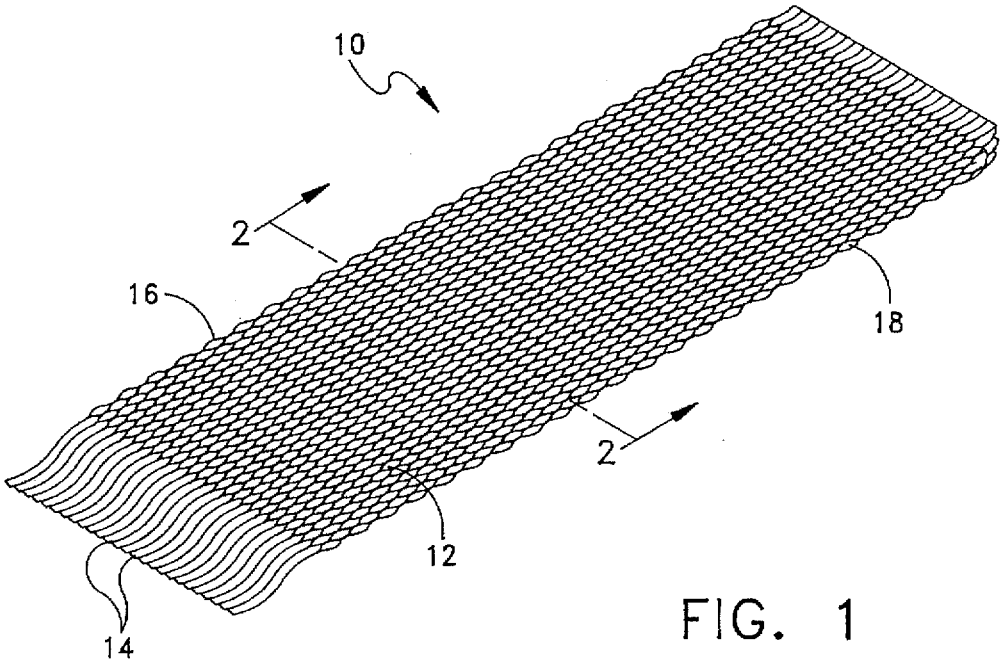
FIG. 1 is a perspective view of a section of webbing having a catch cord fabricated from bicomponent yarn of the present invention.
Figure 2:
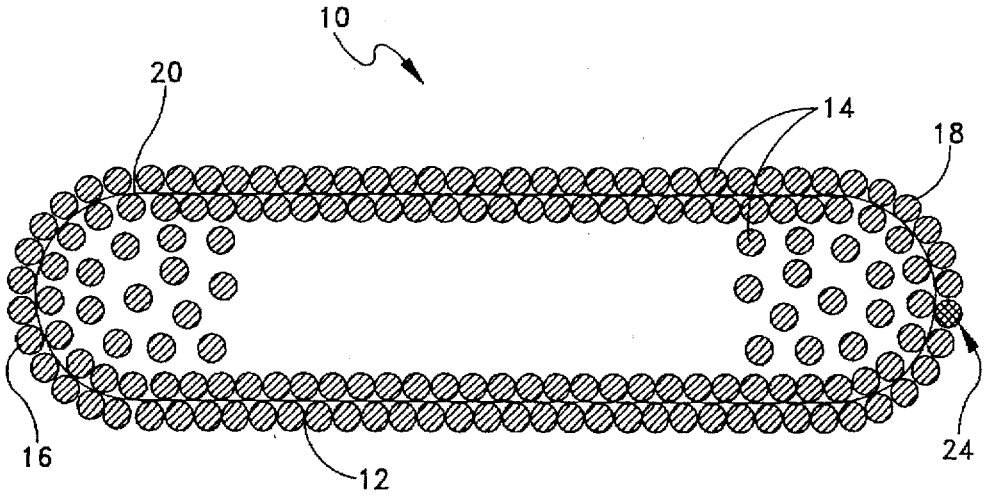
FIG. 2 is a cross-sectional view of the webbing taken along line 2—2 of FIG. 1.
Figure 3:
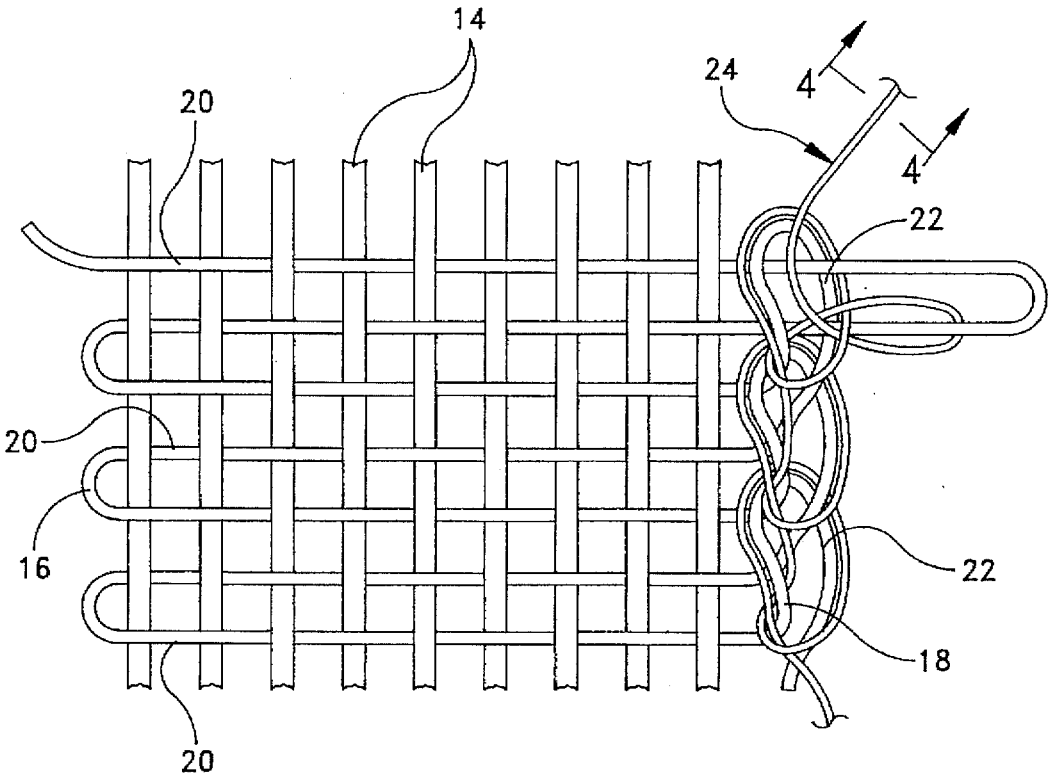
FIG. 3 is a detail view of the catch cord as it is woven through fill (weft) yarn of the webbing.

Referring now to the drawings, and more particularly to FIGS. 1–3, there is generally indicated at 10 a section of an elongate webbing suitable for use in commercial settings, such as for strapping, safety ropes, and the like. As shown, the webbing is provided with a main body 12 made up of warp yarns 14 packed to form a generally rectangular cross section having relatively narrow end edges 16, 18. The body 12 further includes weft or fill yarns 20 (see FIG. 3) extending transversely with respect to the warp yarns 14. The webbing 10 is fabricated pursuant to any suitable process known in the art of textile manufacture. Preferably, the section of webbing 10 is fabricated in accordance with a weaving process which results in the fill yarn loops 22 along one edge (e.g., edge 18 in FIG. 3) of the webbing. The warp and weft yarns 14, 20 are fabricated from any suitable fiber used for such webbing.

Turning to FIGS. 2 and 3, there is generally indicated at 24 a catch cord fabricated from a bicomponent yarn for interconnecting the fill yarns 20 adjacent the right-hand edge 18 of the webbing 10. As mentioned above, during the manufacture of the webbing 10, when producing the webbing 10 on certain weaving machines, the fill yarns create loops 22 on one edge of the webbing. These loops 22 generally remain loose and are subject to unwanted catching or pulling when engaging objects. This can result in the unravelling of the webbing 10 should stress be exerted on any of the fill yarns 20. The catch cord 24 is provided for interconnecting or "tying" the open loops 22 created by the fill yarns 20 on the long edge 18 of the webbing 10. However, if left untreated, the catch cord 24 can also be pulled, resulting in the unravelling of the fill yarns 20 as well.

Figure 4:
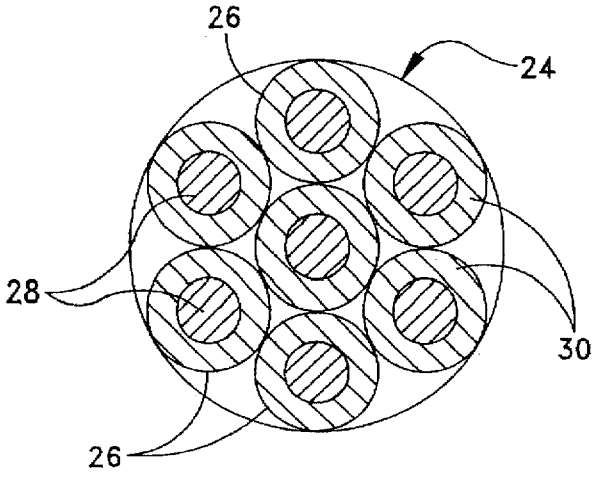
FIG. 4 is a cross-sectional view of the catch cord taken along line 4—4 of FIG. 3.

More particularly, the catch cord 24 consists of bicomponent multiple filaments, each indicated at 26 in FIG. 4. Each filament 26 has a polyester core 28 that melts at a temperature of around 489° F., and a sheath 30 that is formed of a polymer selected from a group consisting of nylon-6, polypropylene, or polyethylene, or any other suitable fiber having a lower melting temperature than the core 28. It has been discovered that by using a bicomponent yarn as the catch cord 24, and by manipulating the catch cord 24 by heating it to a temperature sufficient to melt the outer sheaths 30 of the filaments 26, the bicomponent yarn melts and adheres to the warp and fill yarns 14, 20 for securing the loops 22 of the fill yarns 20 to one another to prevent the webbing 10 from unravelling.

Once the webbing 10 has been constructed so that the catch cord 24 is interwoven through the loops 22 of the fill yarns 20, the webbing 10 is then subjected to a temperature treatment that is sufficient to melt the sheaths 30 of the filaments 26, but not the cores 28. As a result of this melting or fusing operation, the molecular characteristics of the catch cord 24, and particularly the sheaths 30, are somewhat altered, resulting in the bonding of the sheaths 30 not only to the cores 28, but also to the warp and fill yarns 14, 20 of the webbing 10. This results in a web-like structure that prevents the unravelling of the catch cord 24 from the fill yarns 20. The temperature treatment can be applied locally to the edge 18 having the catch cord 24, or to the entire webbing 10.

Preferably, the bicomponent yarn of the catch cord 24 has a sheath 30 of nylon-6 that is treated for four minutes at about 435° F. Another version of the invention uses a sheath 30 of polypropylene that is treated for four minutes at around 375° F. A still further version of the invention uses a sheath 30 of polyethylene which is treated for four minutes at a temperature of around 300° F. In each case, the bicomponent yarn has substantially the same modulus of elasticity as the synthetic yarns 14, 20 of the main body 12, even after the fusing operation.

It should be observed that the webbing 10 of the present invention having the catch cord 24 fabricated from bicomponent yarn is a cost-efficient and effective solution to the problem of catch cord unravel. It can therefore be seen that for these reasons, the instant invention is believed to represent a significant advancement in the art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. An elongate webbing having opposed longitudinal edges formed from warp and fill yarns interwoven together, and a catch cord for interconnecting the fill yarns adjacent one of the longitudinal edges, said catch cord being fabricated from a yarn having a component with a melting point lower than the warp and fill yarns for bonding of the catch cord with said warp and fill yarns when being subjected to a melting temperature sufficient to melt the catch cord but not the warp and fill yarns.

2. A webbing as set forth in claim 1, said catch cord being fabricated from a bicomponent yarn having a plurality of individual filaments, each filament having a core and an outer sheath, the melting point of the sheath being lower than that of its core.

3. A webbing as set forth in claim 2, said core of each filament being fabricated from polyester having a melting point at about 489° F., and said sheath of each filament being fabricated from a group consisting of nylon-6, polypropylene, or polyethylene, or any other material having a lower melting point than the melting point of the core.

4. A webbing as set forth in claim 2, said catch cord being subjected to a temperature treatment sufficient to melt said sheaths, but not said cores.

* * * * *